United States Patent [19]

Haas et al.

[11] 4,224,484

[45] Sep. 23, 1980

[54] TIME SWITCHING DEVICE

[75] Inventors: Wolfgang Haas; Peter Schonhardt, both of St. Georgen, Fed. Rep. of Germany

[73] Assignee: Dieter Graesslin Feinwerktechnik, Fed. Rep. of Germany

[21] Appl. No.: 912,854

[22] Filed: Jun. 5, 1978

[30] Foreign Application Priority Data

Jun. 4, 1977 [DE] Fed. Rep. of Germany ..... 2725397

[51] Int. Cl.[2] ..... H01H 43/10

[52] U.S. Cl. ..... 200/38 FB; 200/51 R; 200/307

[58] Field of Search ..... 200/38 FB, 38 D, 38 R, 200/51 R, 307; 46/25; D13/24, 32, 40; 339/8 P, 119 R, 121, 211

[56] References Cited

U.S. PATENT DOCUMENTS

| | | | |
|---|---|---|---|
| 2,472,363 | 6/1949 | Blackinton | 46/25 |
| 3,548,125 | 12/1970 | Banathy et al. | 200/38 D |
| 3,867,642 | 2/1975 | Ajrulahi | 200/38 D X |
| 3,900,712 | 8/1975 | Fukao | 200/307 |
| 4,001,527 | 1/1977 | Hulshizer | 200/51 R X |
| 4,130,748 | 12/1978 | Schwer | 200/38 FB X |

*Primary Examiner*—James R. Scott

*Attorney, Agent, or Firm*—Hill, Van Santen, Steadman, Chiara & Simpson

[57] ABSTRACT

A time switching device for controlling dependent devices wherein the time switch device consists of at least two time switch assemblies, the device being provided with a common electric power inlet connector and each of the assemblies being provided with at least one assembly controlled power output connector whereby two or more dependent devices can be controlled from a single electric source.

2 Claims, 6 Drawing Figures

TIME SWITCHING DEVICE

BACKGROUND OF THE INVENTION

1. Field of the Invention

This invention relates to electrical time switching apparatus.

2. Prior Art

Prior art time switching apparatus has, for the most part, consisted of individual time switches containing a power inlet connector and a controlled power outlet connector. The power outlet connector is switched between activated and deactivated states in dependent response to a timing mechanism which may, for example, be a synchronous motor. The dependent device to be controlled by the timing switch is provided with power from the controlled outlet connector.

However, it is often necessary or desirable to provide that a plurality of dependent devices cooperates in controlling an overall single function. As an example, in the control of an aquarium various independent dependent devices such as, heating, lumination, feeding, water circulation and other devices may be necessary for proper control of a single aquarium. It is therefore desirable that these devices act in concert. However the devices may be such that intermittent, possibly overlapping, operation is desired so as to preclude the use of a single time switch.

In order to fulfill such requirements, it has been known to provide time switches and/or other timing devices which require expert installation and adjustment. These time switches are then provided with corresponding electric connecting devices and, particularly with controlled sockets for connection to the individual dependent devices.

Such prior devices are not only technically and spatially relatively complex to design and lay out for the respective use, but are, also, expensive, at least in part because of the necessity of expert installation, and are of single purpose.

It would therefore be an advance in the art to provide an economical, technically uncomplex, and spatially compact device which is capable of providing time switching operations for use in controlling a plurality of individual dependent devices such that the devices can be independently controlled from one another from a single time switch device. Moreover it would be an advance in the art to provide such a time switch device which does not require the use of personnel expert in the art to construct, program, and place into operation. Finally it would be an advance in the art to provide such a device where the technical, spatial and economic expenses of the device are maintained as small as possible.

SUMMARY OF THE INVENTION

It is a primary object of this invention to provide the above-described advances in the art. This objective is achieved by providing a time switch device in which at least two time switching assemblies are arranged in a joint housing assembly having a common electrical energy input connector, each of the switching assemblies having, respectively, at least one electric output connector which is spatially and technically adjacent its associated time switch control.

In a preferred embodiment the electric output connector for each time switch assembly can be a plug socket which is arranged both technically and spatially adjacent to the respective time switch mechanisms of the individual assembly. In the illustrated embodiment the socket may be provided with a time dial which surrounds the socket in a ring while triggering lugs or jockeys are circumferentially moveably associated with the time dial and are therefore moveable about the socket. Internally of the housing, immediately adjacent the output plug socket, the drive mechanism for the timing system and the time dependent switch for the socket can be placed. In this manner the five individual units of the assembly i.e. the output connector, the time dial, the positionably activating lugs, the time drive system and the switch can all be advantageously positioned with respect to one another. Moreover the three elements which are used by the programming entity, the socket, the time dial and the positionably trigger lugs or jockeys, are all positioned at one face immediately adjacent one another.

This inventive device not only provides for a technically and spatially clean, simple and aesthetically pleasing arrangement, the device can be easily operated by untrained personnel. Moreover the individual time switch assemblies constructed according to this technique are particularly well adapted for multiplication such that a plurality of individual switch assemblies can be assembled in or into a common housing and be provided with a common single electric input connector. Such a multiple unit is advantageous, particularly for operating multiple dependent devices as discussed above. Moreover because such multiple units have a single electrical input, while providing a plurality of independently timed electrical outputs, the entire system to be controlled can be programmed by unskilled personnel following relatively simple instructions. Moreover due to the building block concept of the individual time switch assemblies, the multiple assembly units are easily designable in a number of permutations such as common or adjacent surfaces, squares, strips, etc. Moreover the simple and economic design of this system is, in itself, advantageous.

It is therefore a general object of this invention to provide an improved time switch device utilizing a plurality of individual time switch assemblies contained in a housing commonly powered from a single power inlet connection, each of the time switch assemblies being provided with technically and spatially adjacent components including a power output connector and timing indicators and actuators therefor.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

In general, the inventive devices illustrated in each of the six figures are characterized by a housing which is provided with plug sockets 2 for connection to dependent devices for the operation of such devices.

Figure 1:
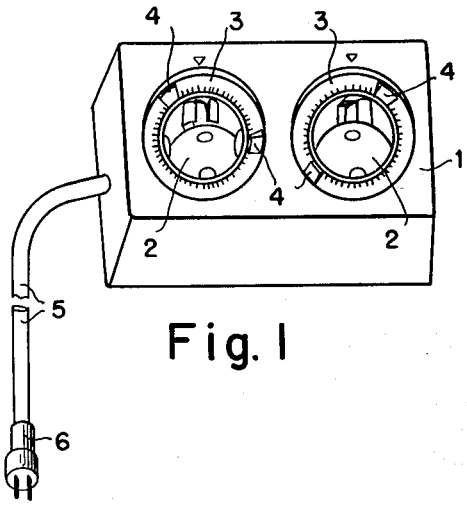
FIG. 1 is a perspective view of a dual time switch assembly according to this invention.

In the embodiment illustrated in FIG. 1, the housing 1 is equipped with two time controlled plug sockets 2 which are positioned spatially closely adjacent one another. Each socket is provided with a rotatable time dial 3 of a time switch (not illustrated). The time switch is contained within the housing 1 immediately adjacent the time dial and socket 2, and can be of a more or less standard design. The time dial 3 is provided with switch jockeys or actuatable switch trips 4 which can be rotated circumferentially around the socket. The time dial itself may be circumferentially rotatable around the socket and, it can be seen from the figure that the path of movement of the jockeys and the time dial are all concentric to the socket. The time dial 3 can be driven by a clock mechanism or by a different type of time switch, for example a short period switch.

The housing 1 is provided with a single common inlet cable 4 having a plug 6 for connection to a prime electric source. Each of the sockets 4 are placeable in electric communication with the power from the cable 5 by activation or deactivation of internal switch assembly controlled by the time dial and jockeys.

Figure 2:
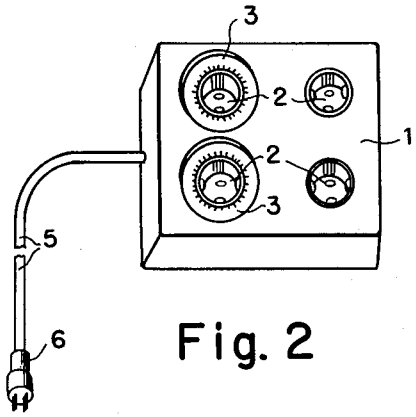
FIG. 2 is a perspective view of a time switch device equipped with two time switch assemblies and two additional output sockets.
Figure 4:
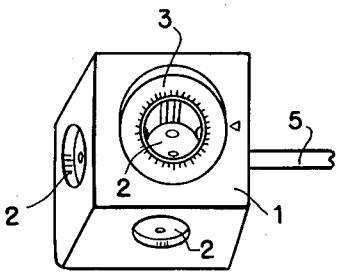
FIG. 4 is a perspective view of a cube-like, partially time controlled, partially non-time controlled time switch device.

FIG. 4 illustrates a quadruple time switch device wherein either all four sockets 2 can be time switch assemblies and thus time controlled or, as illustrated two of the sockets may be time switch assemblies and two sockets be untimed and be in direct electric communication to the central energy supply via cable 5 and plug 6. Again, in the embodiment of FIG. 2, numeral 3 indicates a time dial for a time switch mechanism which is not specifically shown since the construction of the internal mechanisms of such a time switch is readily available to those skilled in the art.

Figure 3:
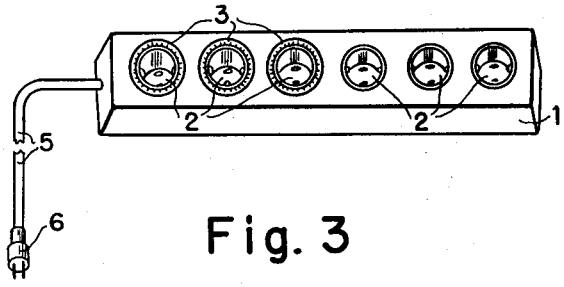
FIG. 3 is a perspective view of a strip-like multiple connecting device provided with both time controlled and non-time controlled output connectors.

A strip-like multiple connector time switch device is illustrated in FIG. 3. In such a construction once again all of the sockets may be time controlled and form individual time switch assemblies or, as illustrated a plurality of time switch assemblies and nontimed sockets may be provided within the common housing 1. Once again numeral 3 indicates the time dial of a time switch, the dial being concentrically arranged around the plug in a ring shape.

It is to be understood that although the time switch assemblies illustrated can include not only the individual elements of the connector or plug socket, time dial and jockeys but also individual internal elements such as the timing mechanism, i.e. a clock mechanism or the like and a switch. Alternatively, only the features of the socket, time dial, jockeys and switch need be provided for each individual time switch assembly with a common timing element provided for a plurality of the adjacent switch assemblies. Thus, a plurality of switch assemblies consisting of controlled connector sockets, time dials, jockeys and associated switches can be provided in a common housing with the time dials of each of the switch assemblies being controlled from a common time measuring element. The coupling of the individual switches and/or of the time dials can be by means of a mechanical interconnection. In such a construction the time measuring element can be a synchronous motor, a quartz operated clockwork or a mechanical clockwork as desired. As a further modification it can be provided that the individual time dials 3 can be uncoupled from the time measuring element. In normal practice the time dial will be rotatably driven by the time measuring element and the switch will be open and closed by the switch jockeys which rotate with the time dial. The switch jockeys are actuatable to move them independently of the time dial to set the period of operation of the switch.

FIG. 4 shows a cube-like device having time controlled and non-time controlled sockets 2 in a single cube-shaped housing 1. The time control sockets are again provided with spatially and technically adjacent time dials 3 which are equipped with triggering jockeys. The time dials are positioned ring-like around the control socket. A common feature of all of the illustrated embodiments is the fact that the elements to be used by the utilizer of the device are all technically and spatially positioned adjacent one another, i.e. the control socket is immediately surrounded by its associated time dial and switch controlling jockeys. Additionally the externally accessible assembly is provided with a technically and spatially adjacent internal switch controlling the socket and actuated by the jockeys.

Figure 5:
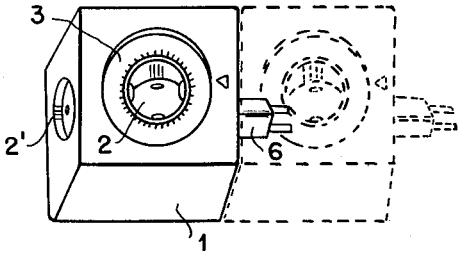
FIG. 5 is a perspective view of a time switch device constructed as a plurality of individual modules connectable together through built-in plugs within a second time switch, illustrated in broken lines, being attached to a first identical time switch.
Figure 6:
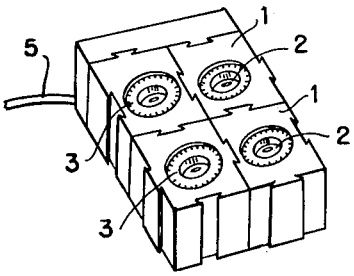
FIG. 6 is a perspective view of a building block time switch device having individual time switch assemblies attachable to adjacent time switch assemblies by means of external configuration interlocks.

FIGS. 5 and 6 may be generally described as building block units. In FIG. 5 a cube-like time switch assembly is provided in a housing 1 where a controlled socket 2 is provided with a time dial 3. A socket 2' is arranged on an adjacent surface of the housing from the time dial switch. A plug is arranged on the opposite adjacent face and is aligned with the socket 2' and is coaxial therewith. Thus a plurality of individual time switch assemblies can be plugged into one another to build a strip of time switch assemblies for a single time switch device. The final plug in the assembly then functions as the connector to the prime energy source. In this construction a time measuring element is provided within each of the individual housings for operation of the individual dependent socket 2.

In the embodiment illustrated in FIG. 6 the mechanical coupling of individual time switch assemblies can be by means of interlocking projections and grooves, such as T grooves and T springs, arranged in alternating sequence at the peripheral faces of the individual assemblies. Of course each of the assemblies can be a time switch device consisting of more than one time switch assembly. The individual time dials of the time switch assemblies can be commonly driven from a central apparatus provided with a time measuring element. Moreover this central device can be provided with a central energy supply. A mechanical coupling of the individual time dials etc. with one another can proceed by means of mechanical driving devices if desired. The electric coupling with one another can proceed by means of sliding contacts in the area of the lateral surfaces adjacent to one another which are indexed to one another during the assembly of the individual time switch assemblies to one another.

Of course it is to be understood that where a cable 5 and plug 6 are as shown that, as shown in FIG. 5, the plug may be built into the housing projecting directly therefrom.

Moreover, it is contemplated within the framework of this invention that other switching apparatus or regulating apparatus such as, for example, temperature regulators, humidity regulators, counters, particularly time counters, can all be used in place of time switches. It is also contemplated that such switching, regulating, and counting devices, together with the described time controlled and non-time controlled sockets 2, can form a single device within a joint housing 1 which may either be a single common housing or a composite housing built from building block components as shown in FIGS. 5 and 6.

Although the teachings of our invention have herein been discussed with reference to specific theories and embodiments, it is to be understood that these are by way of illustration only and that others may wish to utilize our invention in different designs or applications.

We claim as our invention:

1. A time switching device for controlling dependent devices by switching an electrical connection comprising:

a housing assembly, at least two time switching assemblies carried by said housing, each of said time switching assemblies having an operatively associated electrical output connector controlled by a time switch of each of said time switching assemblies, programmable controls for each assembly, the individual components of each of the time switching assemblies being spatially positioned adjacent to one another with in said housing, a single electrical input connector to said housing providing power to both of said output connectors under control of said time switches, the output connectors being plug sockets, the time switch assemblies including time dials, the time dials enclosing the plug sockets in ring form around said plug sockets, the time dials being rotatable with respect to the plug sockets, the time dials controlling on-off actuation of switches of the associated socket, the time dials being programmable to open and close each switch of the associated time switch assembly, said time dials being viewable from a top surface of said housing assembly, having spaced top and bottom surfaces, the plug sockets being accessible through the top surface, the top surface having openings therethrough exposing the plug sockets, a time measuring element provided with in said housing, said time measuring element driving said time dials, the time switching assemblies being assembled together to form a single piece strip housing, the plug sockets being arranged in the top face perpendicular to a back face of the housing adjacent one another and electrically interconnected to a common electrical input.

2. A device according to claim 1 wherein at least one non-timed switch electrical output plug socket is carried by said housing accessible through said front surface.

* * * * *